US007207278B2

(12) United States Patent
Latino et al.

(10) Patent No.: US 7,207,278 B2
(45) **Date of Patent: *Apr. 24, 2007**

(54) ELECTRICALLY-DRIVEN COMPUTER MONITOR LIFT AND STORAGE ASSEMBLY

(75) Inventors: Richard M. Latino, Sterling, MA (US); Edward Mello, Franklin, MA (US)

(73) Assignee: Wright Line, LLC, Worcester, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/366,012

(22) Filed: Mar. 2, 2006

(65) Prior Publication Data

US 2006/0169188 A1 Aug. 3, 2006

Related U.S. Application Data

(63) Continuation-in-part of application No. 10/613,183, filed on Jul. 3, 2003, now Pat. No. 7,063,024.

(51) Int. Cl.
*A47B 37/00* (2006.01)

(52) U.S. Cl. ..... 108/50.01; 108/147

(58) Field of Classification Search ..... 108/50.01, 108/50.02, 147, 147.19; 312/196, 194, 223.6, 312/223.2, 223.3; 248/188.2, 162.1, 161; 345/905; 361/681, 683
See application file for complete search history.

(56) References Cited

U.S. PATENT DOCUMENTS 4,735,467 A * 4/1988 Wolters ..... 312/29
5,020,752 A * 6/1991 Rizzi et al. ..... 248/162.1
5,526,756 A * 6/1996 Watson ..... 108/147
5,682,825 A * 11/1997 Manner ..... 108/147
5,763,985 A * 6/1998 Asinovsky ..... 312/223.2
5,778,803 A * 7/1998 Machael ..... 108/147
5,797,666 A * 8/1998 Park ..... 312/319.5
5,927,213 A * 7/1999 Leday ..... 108/96
6,007,036 A * 12/1999 Rosen ..... 248/286.1
6,463,862 B1 * 10/2002 Kuhlman et al. ..... 108/50.01
6,556,678 B1 * 4/2003 Boyce ..... 379/454
6,609,465 B2 * 8/2003 Kolavo ..... 108/50.01
6,612,670 B2 * 9/2003 Liu ..... 312/312
6,733,094 B1 * 5/2004 Chang ..... 312/7.2
6,827,409 B2 * 12/2004 Michael ..... 312/223.3

* cited by examiner

*Primary Examiner*—Jose V. Chen
(74) *Attorney, Agent, or Firm*—Brian M. Dingman; Mirick, O'Connell, DeMallie & Lougee, LLP

(57) ABSTRACT

An assembly for selectively lifting a computer monitor, and particularly a flat screen computer monitor, from a storage position below the top of a desk or table, to a use position above the top in which the monitor is visible to the user. The assembly includes a stationary member including a linear slide mechanism, a vertically slideable support member sized and dimensioned to receive a computer display monitor and coupled to the linear slide mechanism. The vertically slideable support member is coupled to an electrically-driven positioning device. When the user desires to lift the monitor onto the top of the desk, the user pushes a switch, which enables the positioning device to drive the vertically slideable support member upward along the linear slide, through an aperture in the desk, until the computer monitor rests on or just above the desktop. Monitor retraction to the stored position is accomplished by the push of another switch.

31 Claims, 21 Drawing Sheets

ELECTRICALLY-DRIVEN COMPUTER MONITOR LIFT AND STORAGE ASSEMBLY

CROSS REFERENCE TO RELATED APPLICATION

This application is a continuation in part of application Ser. No. 10/613,183 filed on Jul. 3, 2003 now U.S. Pat. No. 7,063,024. Priority is claimed.

FIELD OF THE INVENTION

This invention relates to an assembly that moves a computer monitor from a stored position under a desk to a use position on the desk.

BACKGROUND OF THE INVENTION

As the need to access computers has increased, computers are increasingly found in meeting rooms, training rooms, and classrooms, as well as on office desks. While access to computers is important in all of these locations, the ability to provide an unrestricted view to a person sitting across a desk, toward a blackboard, or across a meeting table is also important, especially to allow for eye contact during a meeting, a discussion, or a lecture. Computer monitors, however, often unreasonably restrict this view, making it difficult for the computer user to see or be seen. Furthermore, computer monitors add significantly to clutter on a desk, making it difficult to use the work surface and often, therefore, causing a need for additional office furniture.

For these reasons, schools, businesses, and offices typically include at least one, and sometimes more, computer training labs or meeting rooms which are dedicated solely to computer training and use. These rooms provide a place for holding a meeting or training session in which a large number of people can each view a computer monitor, and are therefore important to computer training and application presentations, lectures, and meetings. These rooms, however, are also expensive, as they require a great deal of dedicated space, as well as significant maintenance and updating. Furthermore, although requiring a significant amount of resources, these rooms are often underused. It is desirable, therefore, to provide a system in which a computer can be selectively retrieved for use and, when not in use, can be easily and inexpensively stowed.

Another problem with computing equipment provided in offices, meeting rooms, and labs is that the equipment is portable, is typically not monitored very closely, and is, therefore, relatively easy to steal, providing both a financial and a security problem for schools and businesses. As computing equipment becomes increasingly small, and hiding the equipment therefore becomes easier, these problems have increased. It is desirable, therefore, also to provide a method for easily and inexpensively stowing and locking computer equipment.

There remains a need, therefore, for a computer desk in which a computer can be selectively provided on the desk, or easily stored and locked.

SUMMARY OF THE INVENTION

In one aspect, the present invention provides a computer monitor lifting device/assembly. The computer monitor lifting device comprises an equipment support, sized and dimensioned for receiving a computer monitor, and a lifting mechanism coupled to the equipment support and adapted to selectively move the equipment support and the computer monitor between a retracted position and an extended position. The equipment support is selectively coupled beneath a work surface in the retracted position and raised onto the work surface in the extended position.

In another aspect, the present invention provides a computer monitor lifting device including a work surface with an aperture, a stationary support provided beneath the work surface, a monitor support moveably coupled to the stationary support and sized and dimensioned to receive a computer monitor, and a lifting mechanism coupled between the equipment support and the stationary support.

In yet another aspect, the present invention provides a computer monitor lifting device for moving a computer monitor between a retracted and an extended position. The computer monitor lifting device comprises a stationary support member adapted to be coupled beneath a work surface, a computer monitor support slidably coupled to the stationary support member, a lifting mechanism coupled to the monitor support, and a switch for operating the lifting mechanism.

The computer monitor support includes a top horizontal member and a bottom horizontal member, both of which are fixed and spaced apart at a distance that is sufficient to accommodate the monitor between the two. The top and bottom horizontal members are sized and dimensioned to be received in an aperture in the work surface. A lifting mechanism provides an upward lifting force directed against the weight of the monitor support when the monitor support is in the retracted position. When the lifting mechanism drives the computer monitor support upward to the extended position, the bottom horizontal surface rests in or just proximate to the aperture in the work surface, and the computer monitor is displayed above the work surface.

Featured in the invention is a computer monitor lifting assembly for moving a computer monitor that is coupled to the device between a retracted and an extended position relative to a work surface, the computer monitor lifting assembly comprising a stationary support member coupled beneath a work surface, a computer monitor support moveably coupled to the stationary support member, the computer monitor support including a fixed top horizontal member and a fixed lower horizontal member spaced below the top horizontal member, the top horizontal member being sized and dimensioned to at least mostly fill an aperture in the work surface when the monitor support is in the retracted position, the top and bottom horizontal members being spaced vertically at a distance sufficient to allow a computer monitor to be coupled to the monitor support between them, a lifting device coupled to the monitor support, the lifting device providing an upward lifting force directed against the weight of the monitor and the monitor support to move the monitor support from the retracted, up through the aperture in the work surface, to the extended position, and a user-operable control for selectively operating the lifting device.

The lifting device may be electrically operated. The lifting device may also provide a downward force that returns the monitor support from the extended to the retracted position. The lifting device may comprise a linear actuator. The linear actuator may comprise an actuation shaft coupled to the monitor support. The linear actuator may further comprise an electric motor adapted to move the shaft outward and inward with respect to the motor. The linear actuator may further comprise a mechanical coupling that translates motor motion to motion of the shaft.

The monitor support may comprise a first mechanical member, and a tilt member that is movably coupled to the first member. The monitor support may further comprise a computer monitor mounting plate to which the monitor is attached. The mounting plate may be coupled to the tilt member. The tilt member may be coupled to the first member with at least one hinge. The monitor support may further comprise a mechanical device for holding the tilt member in a desired position relative to the first member. The mechanical device for holding the tilt member in a desired position relative to the first member may comprise a gas spring.

The monitor support may further comprise a mechanical locking device that inhibits removal of the mounting plate from the tilt member. The mounting plate may be coupled to the tilt member with one or more fastener and nut combinations. In this case, the locking device may prohibit the nuts from being removed from the fasteners. The locking device may comprise a second mechanical member that is selectively coupled to the tilt member by a lock member.

The lifting device may be adapted to move the monitor support a distance essentially equal to the distance between the top horizontal member and the lower horizontal member. The user-operable control may comprise a switch. The work surface may be the top of a desk. The user-operable control may be accessible by a user sitting at the desk. The computer monitor lifting assembly may further comprise a trim piece lining the inside of the aperture.

The computer monitor support may be moveably coupled to the stationary support through a linear slide mechanism. The linear slide mechanism may comprise a pair of linear ball bearing slides, one on each side of the computer monitor support. The computer monitor lifting assembly may further comprise an enclosure for enclosing the computer monitor when the computer monitor is in the retracted position. The enclosure may be lockable.

Featured in another embodiment is a computer monitor lifting assembly for moving a computer monitor that is coupled to the device between a retracted and an extended position relative to a work surface, the computer monitor lifting assembly comprising a stationary support member coupled beneath a work surface, a computer monitor support moveably coupled to the stationary support member, the computer monitor support including a fixed top horizontal member and a fixed lower horizontal member spaced below the top horizontal member, the top horizontal member being sized and dimensioned to at least mostly fill an aperture in the work surface when the monitor support is in the retracted position, the top and bottom horizontal members being spaced vertically at a distance sufficient to allow a computer monitor to be coupled to the monitor support between them, an electrically-operated lifting device coupled to the monitor support, the lifting device providing an upward lifting force directed against the weight of the monitor and the monitor support to move the monitor support from the retracted, up through the aperture in the work surface, to the extended position and also providing a downward force that returns the monitor support from the extended to the retracted position, and a user-operable switch for selectively operating the lifting device.

Featured in yet another embodiment is a computer monitor lifting assembly for moving a computer monitor that is coupled to the device between a retracted and an extended position relative to the top surface of a desk or table, the computer monitor lifting assembly comprising a stationary support member coupled beneath the top surface of the desk or table, a computer monitor support moveably coupled to the stationary support member, the computer monitor support including a fixed top horizontal member and a fixed lower horizontal member spaced below the top horizontal member, the top horizontal member being sized and dimensioned to at least mostly fill an aperture in the top surface when the monitor support is in the retracted position, the top and bottom horizontal members being spaced vertically at a distance sufficient to allow a computer monitor to be coupled to the monitor support between them, an electrically-operated motor-driven linear actuator coupled to the monitor support, the linear actuator providing an upward lifting force directed against the weight of the monitor and the monitor support to move the monitor support from the retracted, up through the aperture in the top surface, to the extended position and also providing a downward force that returns the monitor support from the extended to the retracted position, and a user-operable switch for selectively operating the linear actuator.

These and other aspects of the invention will become apparent from the following description. In the description, reference is made to the accompanying drawings which form a part hereof, and in which there are shown preferred embodiments of the invention. Such embodiments does not necessarily represent the full scope of the invention and reference is therefore made to the claims for understanding the true scope of the invention.

DETAILED DESCRIPTION OF THE PREFERRED EMBODIMENTS OF THE INVENTION

Figure 1:
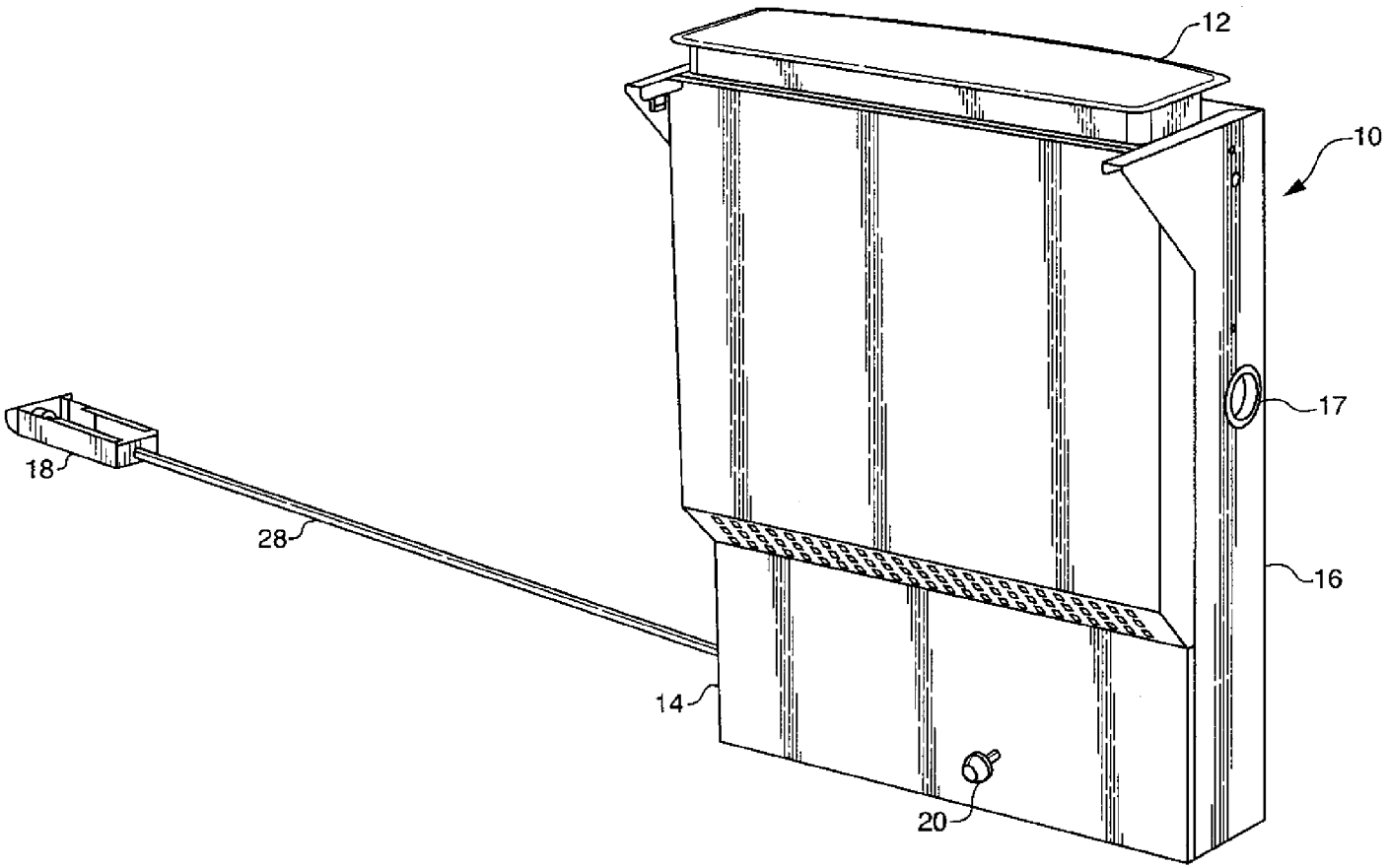
FIG. 1 is a perspective view of a computer monitor lift mechanism constructed in accordance with the present invention.

A first embodiment is shown in FIGS. 1–10. Referring now to the figures and more particularly to FIGS. 1, 9, and 10 a computer monitor lifting mechanism 10 constructed in accordance with the present invention is shown. The computer monitor lifting mechanism 10 comprises a stationary under-desk support mechanism 16, a vertically slidable monitor support 12, a lockable monitor enclosure 14 and a latch release mechanism 18. As described more fully below, in use the under-desk support mechanism 16 is positioned beneath an aperture 78 (FIG. 9) in a desktop 80, and a computer monitor 19 (FIG. 10) is positioned on the monitor support 12. Upon release of the latch mechanism 18, the monitor support 12 slides vertically through the aperture 78 such that a computer monitor can be selectively stored beneath the desk 74 or on the desktop 80. When stored under the desk 74, the lockable mounting enclosure 14 secures the monitor to prevent damage or theft. An aperture 17 is provided in a side of the computer lifting mechanism 10 to allow for routing of electrical cables.

Figure 2:
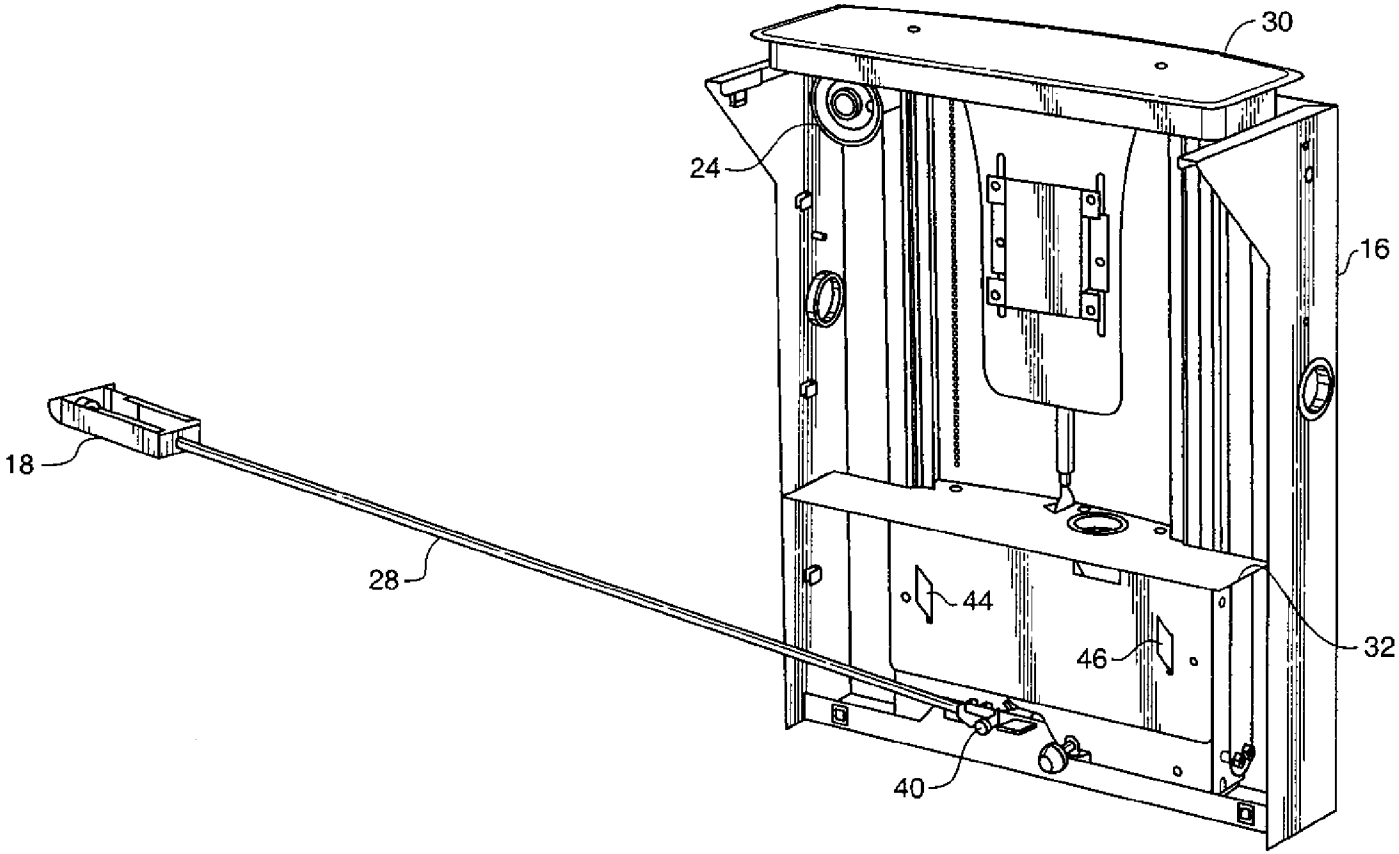
FIG. 2 is a view of the computer monitor lift mechanism of FIG. 1, with the lockable enclosure removed, in a retracted position.
Figure 3:
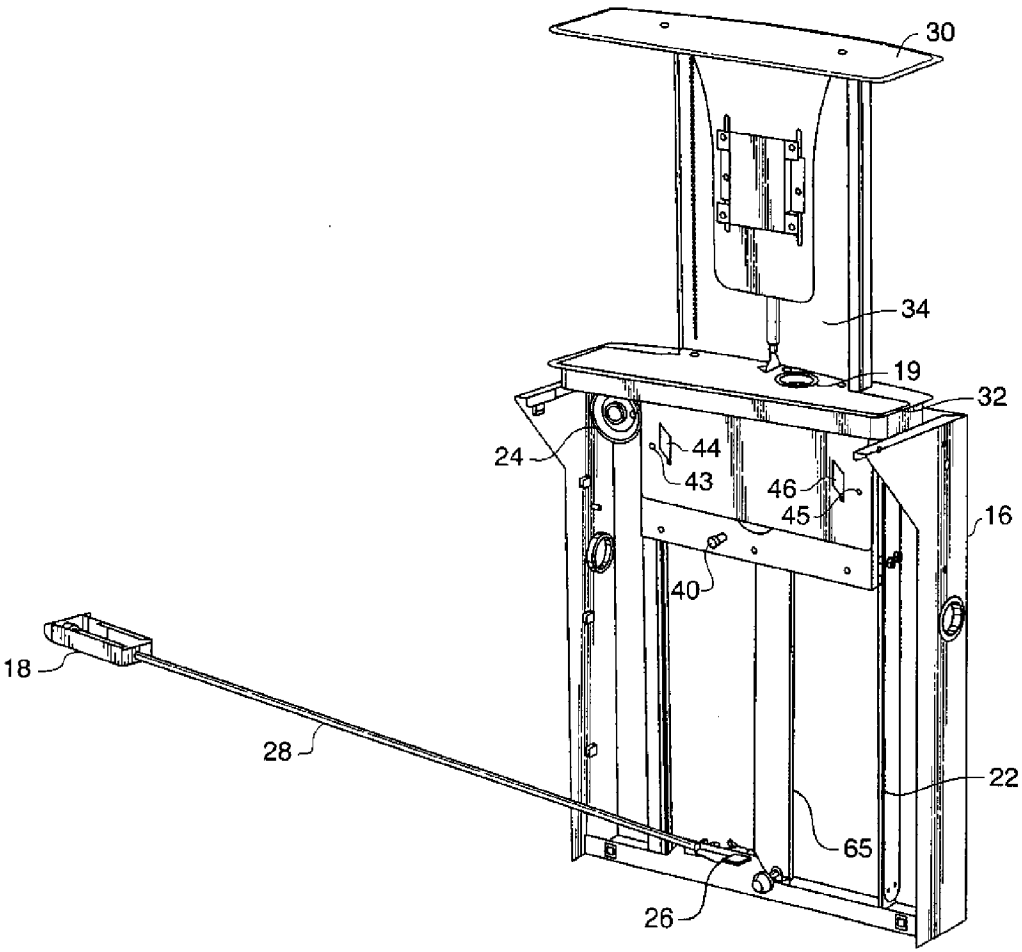
FIG. 3 is a perspective view of the computer monitor lift mechanism of FIG. 2, in an expanded position.

Referring now to FIGS. 2 and 3 the computer lifting mechanism 10 is shown with the lockable enclosure 14 removed and with the vertically slidable monitor support 12 in each of a retracted and extended position, respectively. The stationary under desk support structure 16 includes a linear slide mechanism 22 along which the monitor support 12 can be moved vertically, a constant force torsional coil spring 24 coupled to the monitor support 12, and a latching mechanism 26. In the retracted position, the latching mechanism 26 retains the monitor support 12 in place, counteracting the force of the coil spring 24. When the latching mechanism 26 is released, the coil spring 24 forces the monitor support 12 upward along the linear slide mechanism 22, effecting movement to the extended position. Electrical wiring is routed through an aperture 19 in the monitor support 12, thereby allowing the monitor 19 to remain connected to a computer provided, for example, below the flat surface, while in both the retracted and extended position.

Figure 4:
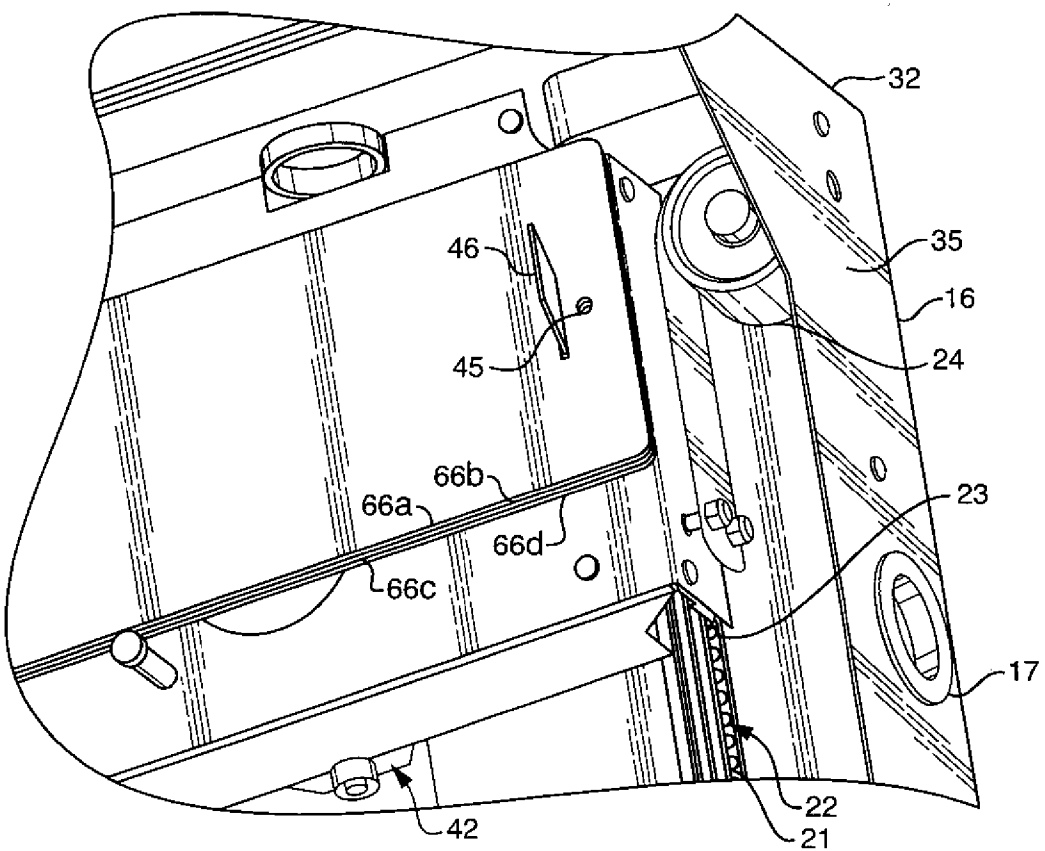
FIG. 4 is detail perspective view of the spring coil and linear slide mechanism.
Figure 7:
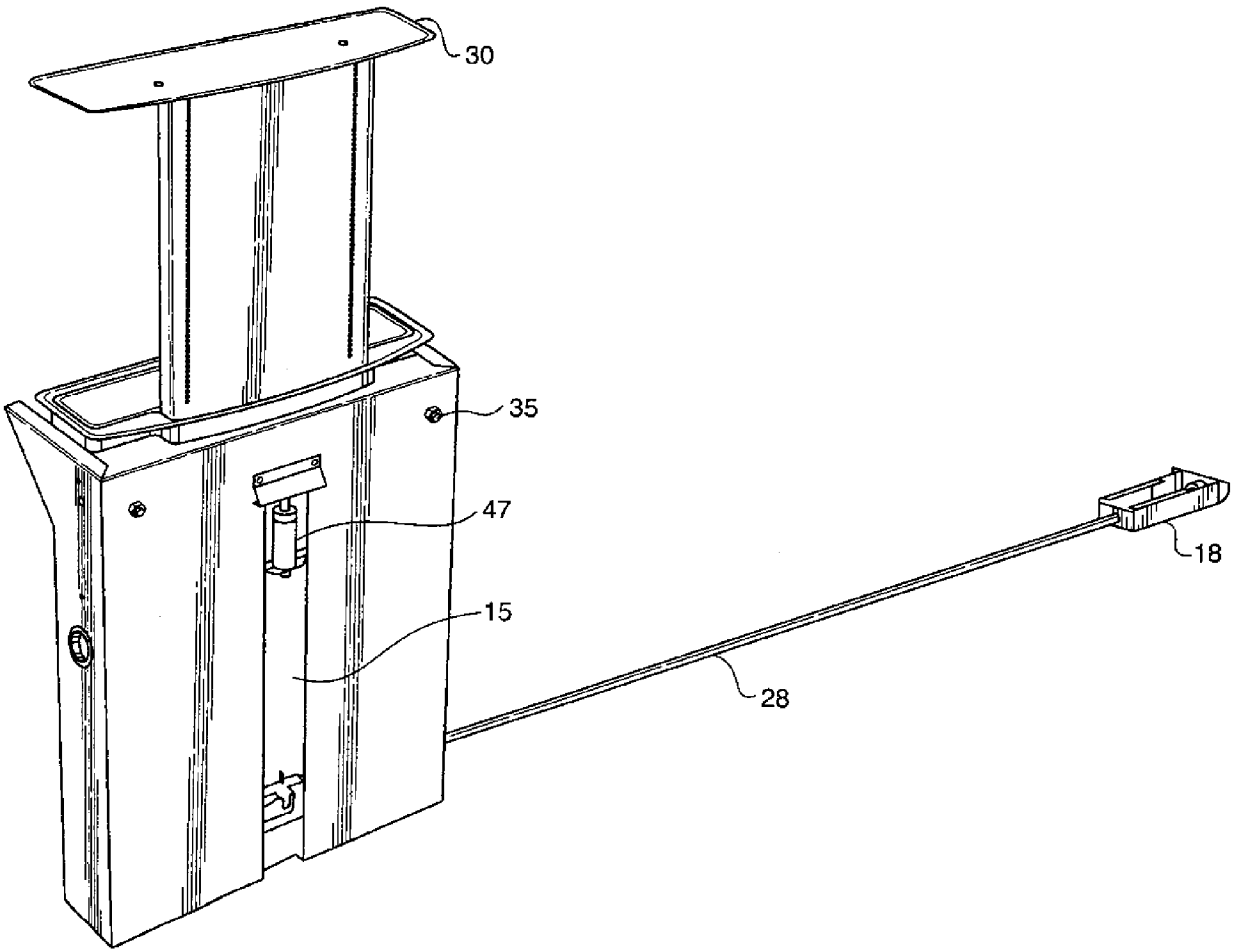
FIG. 7 is a back view of the computer lifting mechanism of FIG. 3 illustrating the brake.

Referring now also to FIG. 4, the linear slide mechanism 22 is a typical linear ball bearing drawer slide mechanism which includes a stationary mounting member 21 coupled to support structure 16, and a moveable rail 23 coupled to the monitor support 12. The rail 23 is sized and dimensioned to be received on and to move along the stationary mounting member 21. The monitor support 12 is further coupled to an end of the torsional coil spring 24 with fasteners 25 and 27. A strike pin 40, FIG. 4, for activating the latch mechanism 26 extends outwardly from the monitor support 12, as described below. The coil spring 24 is further coupled to the back wall of the stationary support with a threaded fastener 35 (FIGS. 4 and 7).

Referring still to FIGS. 2 and 3 the monitor support structure 12 comprises a substantially horizontal top plate 30 and a substantially horizontal bottom plate 32, each of which are sized and dimensioned to sit flat in the aperture 78 in the desktop 80, such that one of the top plate 30 and the bottom plate 32 covers the aperture 78 and is flush with the desktop 80 in each of the retracted and extended positions, respectively. The distance between the top plate 30 and the bottom plate 32 is selected to receive a flat screen computer monitor which rests on the bottom plate 32, and below the top plate 30. The top plate 30 and bottom plate 32 are coupled together with a substantially vertical back plate 34, the back plate 34 being rotatably coupled to the bottom plate 32 through a tilting mechanism 36 which allows the monitor to be rotated or tilted to provide a better viewing angle for a user when in the expanded position. A monitor mounting plate 39, including apertures for receiving fasteners for mounting the monitor to the monitor support 12 is coupled to the vertical back plate 34, and a pneumatic cylinder 37 is coupled between the bottom plate 32 and the monitor mounting plate 39 to provide stability.

Figure 5:
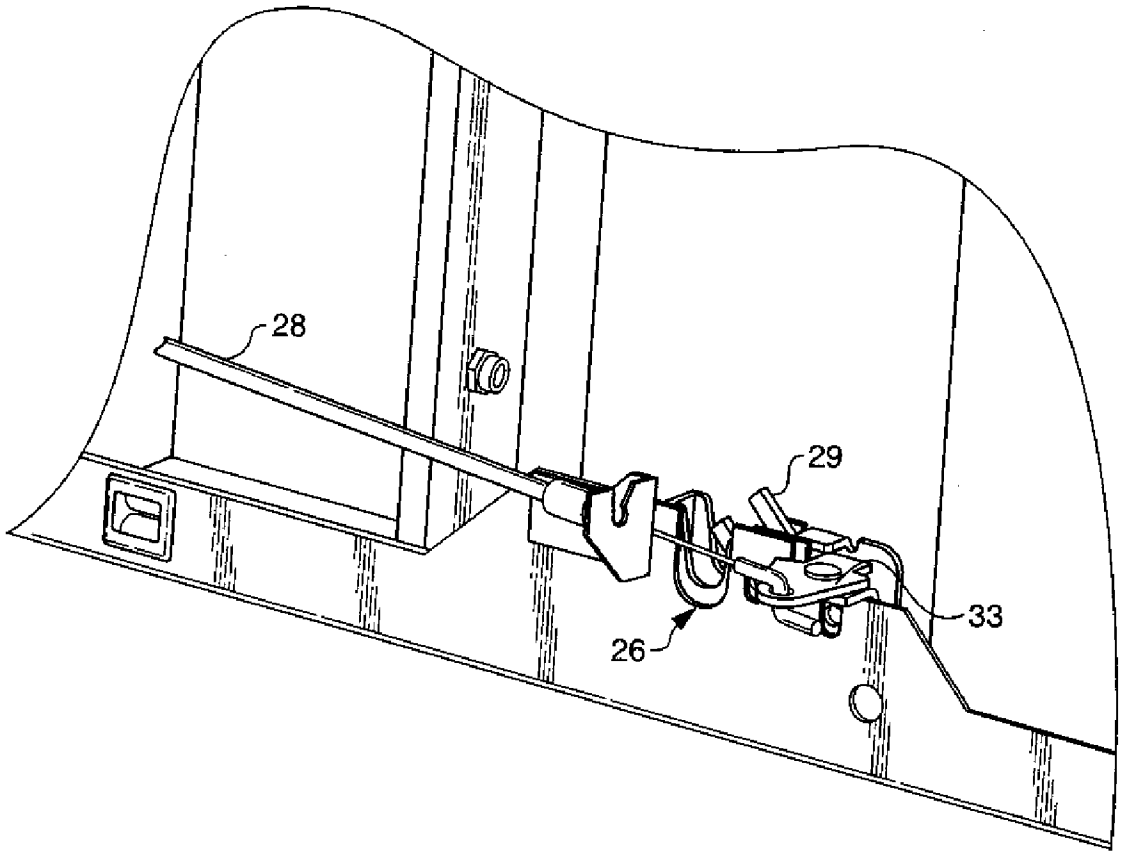
FIG. 5 is a detail perspective view of the latching mechanism.

As described above, a strike pin 40 is provided on the monitor support 12, beneath the bottom plate 32 and near a bottom end of the monitor support 12. Referring now also to FIG. 5, the strike pin 40 interacts with the down position latch mechanism 26 to latch the vertically slidable monitor support structure 12 in the retracted position. The latch mechanism 26 is a commercially available down position rotary type "slam" latch mechanism, including a rotatable latching member 29 which is moveable between a locked and an unlocked position. The rotatable latching member 29 includes a channel 31 sized and dimensioned to receive the strike pin 40, and is rotated to the locked position as the strike pin is pushed downward into the channel 31. A release mechanism 33 is coupled to a push-pull cable 28, which, referring again to FIGS. 2 and 3, is coupled to the latch release mechanism 18. When the push pull cable is activated, the release mechanism 33 is rotated horizontally to release the latching member 29 by allowing the rotational member to rotate upward to the position shown in FIG. 5.

Figure 6:
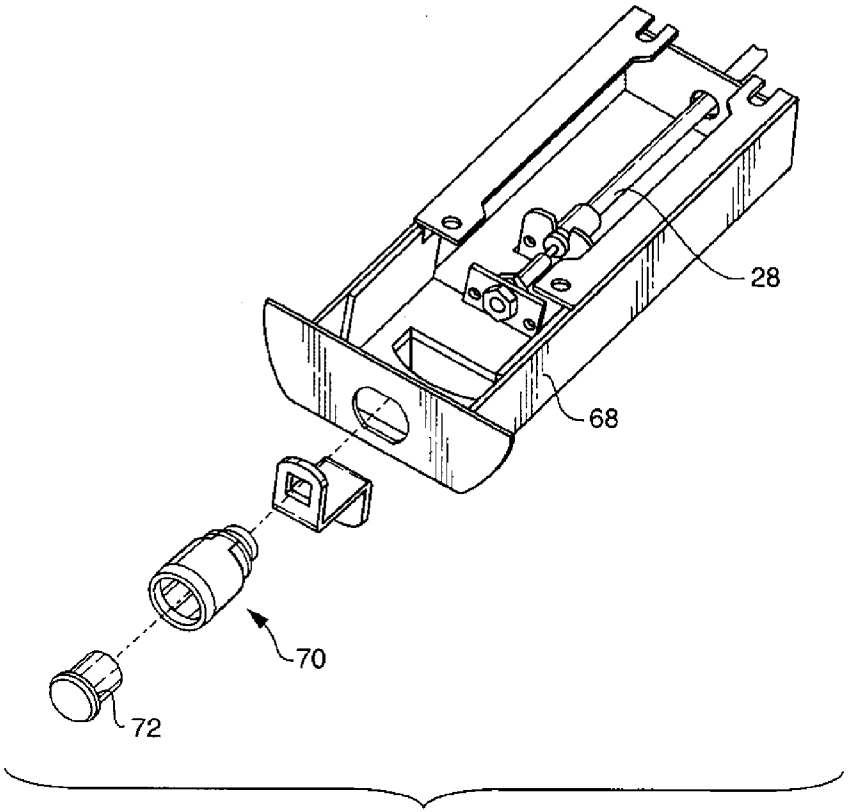
FIG. 6 is a perspective view of the latching release mechanism of FIG. 1.

Referring now to FIG. 6, the latch release mechanism 18 comprises a formed sheet metal channel 68 in which the push-pull cable 28 is provided. The push-pull cable 28 is coupled to a slidable release trigger 70 which is selectively operated by a key operated cam lock 72 which, when positioned in the locked position, impedes the movement of the release trigger 70. In the unlocked position, the lock 72 pulls on the cable 28 to release the latch mechanism 26, so the lift moves to the extended position. Referring again to FIGS. 2 and 3, as described above, the opposing end of the push-pull cable 28 is coupled to the release member 33 of the latch mechanism 26 in the stationary support 16, and is threaded through clips 51, 53, and 55 provided in the stationary support member between the latch mechanism and the latch release mechanism 18.

Figure 8:
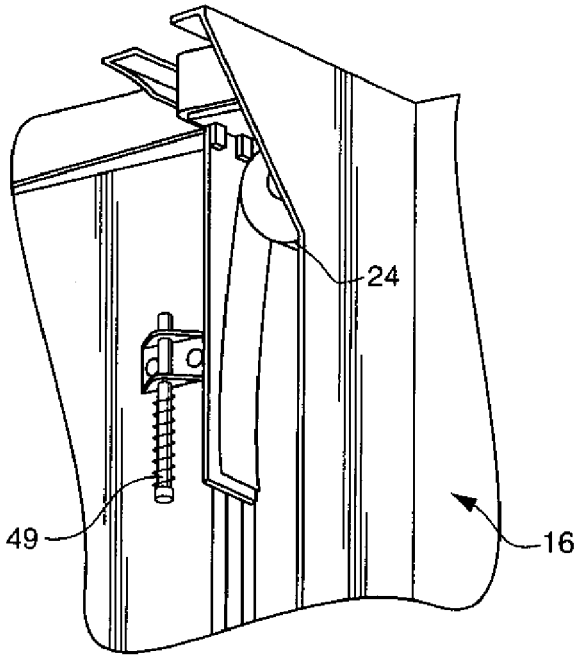
FIG. 8 is a perspective view of the front of the stationary support with the computer monitor support removed to illustrate a stop spring.

Referring now to FIG. 7, a back panel of the stationary support 16 includes a channel 65 including a flangular stop 67 near the top of the support 16. The channel 65 receives a deceleration braking assembly 42 including a commercially available shock absorber or snubber brake 47 coupled to a bracket 49 extending from the back of the monitor support 12, beneath the bottom plate 32. The deceleration braking assembly 42 moves through the channel 65 with the monitor support 12, and engages the flangular stop 67 at the top of the channel 65, decelerating the monitor support 12 as it approaches the end of motion. Referring now also to FIG. 8, the stationary support 16 can also include a spring loaded final stop point 49 to avoid final solid impact of the monitor support 12 if any residual force and movement remain due to insufficient deceleration.

Referring again to FIGS. 2 and 3 and also to FIG. 4, the monitor support 12 further comprises sheet metal counterweights 66*a*, 66*b*, 66*c*, 66*d* which are selectively added to the monitor support 12 below the bottom plate 32, slid onto brackets 44 and 46, and locked in place with threaded fasteners (not shown) received in apertures 43 and 45. The counterweights 66 are selectively applied to balance the weight of the computer monitor provided in the monitor support 12 against the force of the constant force torsional coil springs 24 and can be incrementally added to assure a relatively slow and smooth transition between the retracted and expanded positions.

Referring again to FIGS. 9 and 10, the computer monitor lift mechanism 10 is shown as mounted to a desk 74 including a work surface or desktop 80 with an aperture 78 in the top of the desk. The stationary support 16 of the flat screen computer monitor lift mechanism 10 is mounted to a back panel of the desk 74 extending from the desktop 80 toward the floor or other surface below, with the vertically slidable monitor support 12 aligned beneath and adjacent the aperture 78. The latch release mechanism 18 extends along, and parallel to, the bottom of the desktop 80 terminating near a front edge of the desktop 80 at a location easily accessible by a user.

After the computer monitor lift mechanism 10 is assembled as described above, the total weight of the monitor is determined and the number of required counterweights 66 (FIG. 6), if any, is selected such that the constant force torsional coil springs 24 (FIGS. 2 and 3) have a slight force advantage over the total weight of the system to be lifted. By controlling the weight appropriately, the vertically slideable monitor support 12 can elevate at a reasonably controlled speed. Furthermore, when the weight is properly selected, only a slight downward force is required to overcome the upward force advantage of the constant force torsional coil springs 24, and to re-seat the vertically slideable monitor support 12 into its down and stored position. Due to the linear force output curve of the constant force torsional springs 24, the force required to re-seat the mechanism remains minimal and constant throughout the mechanism's entire downward travel. Thus, re-seating of the slideable support member 12 into the down and stored position can easily be achieved from a sitting position.

When the stationary support 16, vertically slideable monitor support 12, latch release mechanism 18, and counterweights 66 are in place, the lockable enclosure 14 can be provided over the stationary support member 16 and monitor support 12 and locked in place to prevent theft or tampering with the computer.

Figure 9:
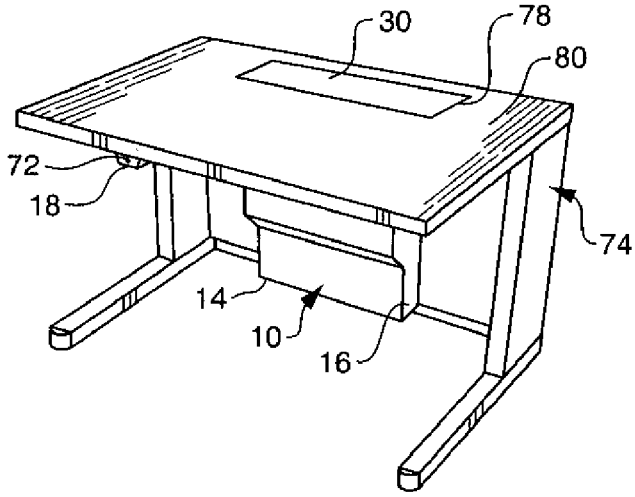
FIG. 9 is a perspective view of a desk including the computer monitor lifting device of FIG. 1, in a retracted mode.
Figure 10:
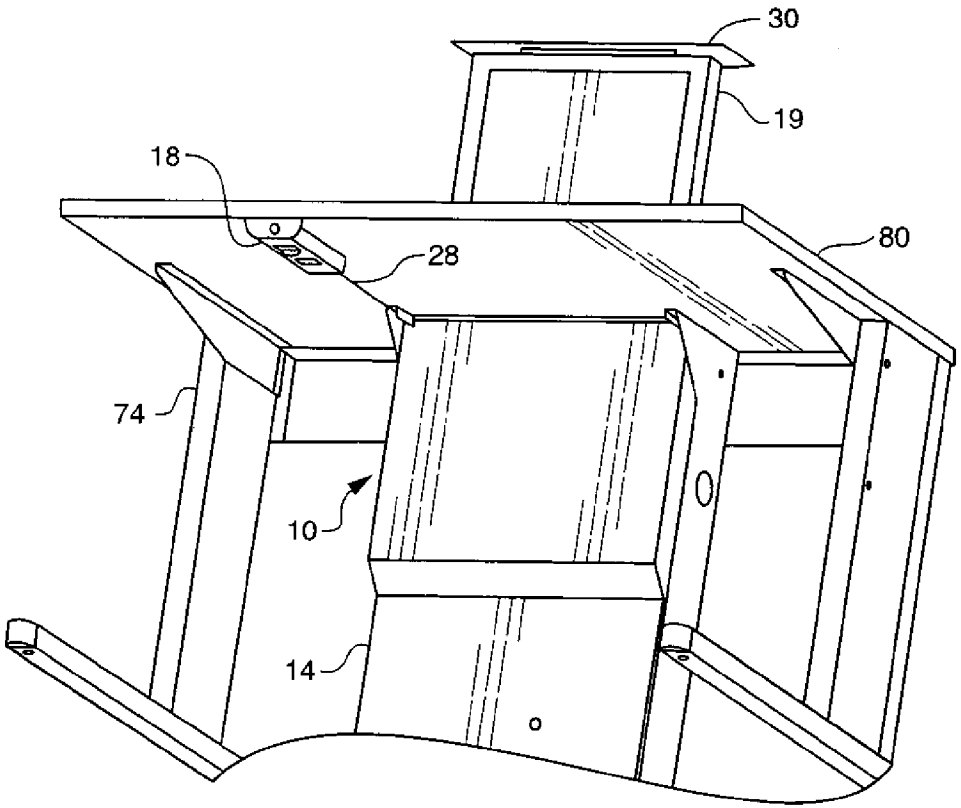
FIG. 10 is a perspective view of a desk including the computer monitor lifting device of FIG. 1 in an expanded mode, with a computer monitor installed.

To move the monitor from the retracted position beneath the desk 74 (FIG. 9) to the extended position (FIG. 10) on the work surface or desktop 80, the user activates the latch mechanism 18 by unlocking the trigger lock 72 and activating the slidable release trigger 70, which in turn activates the push-pull cable 28 causing the strike pin 40 to be released from the latch member 26 and allowing the constant force torsional coil spring 24 to drive the monitor support 12 upward through the aperture 78 to the extended position as shown in FIG. 10. In the extended position the bottom plate 32 rests in the aperture 78 and sits flush with the desktop 80 to provide a clean aesthetic finish for the desktop 80. As the vertically slidable monitor support 12 approaches the end of motion, the brake 47 engages the flangular stop 67 (FIG. 7) at the top of the channel 65 prior to the end of travel, causing the monitor support 12 to decelerate. A spring loaded final stop point 49 (FIG. 8) can be provided behind the vertically slidable mounting support 12 to avoid final solid impact of the mechanism if any residual force and movement remain due to insufficient deceleration. The brake 47 is reset when the slidable monitor support 12 is forced down and returned to its down and stored position.

The user returns the vertically slideable monitor support 12 to its down and stored position by manually pushing down on the top plate 30 until it seats flush with the aperture 78 in the desktop 80, as shown in FIG. 9. In the retracted position, the vertically slidable monitor support 12 is held below the aperture 78 by the strike pin 40 held in the latch mechanism 26 on the stationary support 16 (FIG. 2). The latch mechanism 26 counteracts the upward direction force of the constant force coil springs 24 to prevent the vertically slidable monitor support 16 from rising along the slide mechanism 22 until the latch mechanism 18 is again released by activation of the slidable trigger 70.

While a computer lift mechanism 10 as described above could be provided in a number of ways, in an illustrative embodiment, the computer monitor lift mechanism 10 is designed to support flat panel monitors having a weight range of from ten to twenty pounds and having a maximum size range equal to that of most commercially available monitors that are generically described as nineteen inches. The computer lift mechanism 10 is designed to vertically transition the supported flat panel monitor from the retracted, secured under-desk storage position to the extended, above-the-desk viewing position without any input from the user other that the operation of the release trigger 70. The power to elevate the monitor is derived from the stored energy source, here "constant force" torsional coil springs 24 (FIGS. 2, 3) and, as described above, is designed to have sufficient energy to lift the selected monitor while overcoming the weight and sliding friction of the vertically slideable monitor supporting structure 12 itself. Also described above, counterweights 66 (FIG. 4) can be selectively added to the vertically slideable monitor support 12 in the event that the mechanism is supporting a monitor having a weight of less than 20 pounds. The counterweights 66 can be provided in sheet metal, avoiding the necessity of expensive and complicated force adjustment mechanisms. Also avoided is the requirement of providing several different mechanism models with various weight capacity ranges. In the illustrative embodiment, the counterweights 66 are provided in one pound increments, which allows reasonably accurate setup for a monitor of the selected size.

As shown and described, the computer monitor support 10 includes two constant force torsional coil springs 24. The constant force torsional coil springs 24 are advantageous in that their force output remains constant throughout their entire operating range which results in a mechanism that is readily balanced, and has a uniform operating speed. These devices also have a cost advantage over alternative devices. The upward force, however, could also be derived from a number of commercially available energy storage devices such as compression springs, extension springs, or gas springs etc., which typically provide a non-linear force output curve, where the output force of the device is indirectly proportional to their linear displacement. Alternately, an electrically driven lead screw could be employed to provide power for both upward and downward translation of the mechanism. See the second preferred embodiment described below. A quantity of at least two springs is advantageous in this first embodiment in preventing the monitor from falling if one spring suddenly fails as the weight of the monitor and the vertically slideable monitor support 12 remains partially supported by the intact spring or springs 24.

As noted above, each of the linear slide mechanisms 22, the latching mechanism 26, the "push-pull" style coaxial cable, the slideable release trigger 70, trigger lock 72, and snubber brake 47 are all commercially available components. However, it will be apparent that similar devices could also be employed. For example, although linear ball bearing sliding mechanisms 22 are described, the slideable monitor support 12 could be guided by other similar means, such as guide bars and bushings, formed steel tracks, or other devices which will be apparent to those of skill in the art. Furthermore, although specific latching devices have been described, similar retention devices could be achieved by other commercially available or proprietarily designed latch mechanisms. Other deceleration devices, such as a friction brake could be used in place of the snubber or shock absorber described above. A similar result could also be obtained using one or more springs.

The monitor 19 (FIG. 10) is preferably attached to the tilting mechanism 36 via an industry standard VESA mounting plate. In the mechanism's down and stored position, the monitor 19 is stored in a vertical orientation with its viewing plane parallel with the mechanism's vertical plane of movement. This position allows the mechanism to be condensed into a minimum front to back dimension. This ultimately minimizes the amount of desktop or work surface space that is consumed by the mechanism's top plate and maximizes the amount of knee space under the desk. When the monitor is raised to its above-the-desk viewing position, the monitor may then be tilted to a comfortable upward viewing angle.

Figure 11:
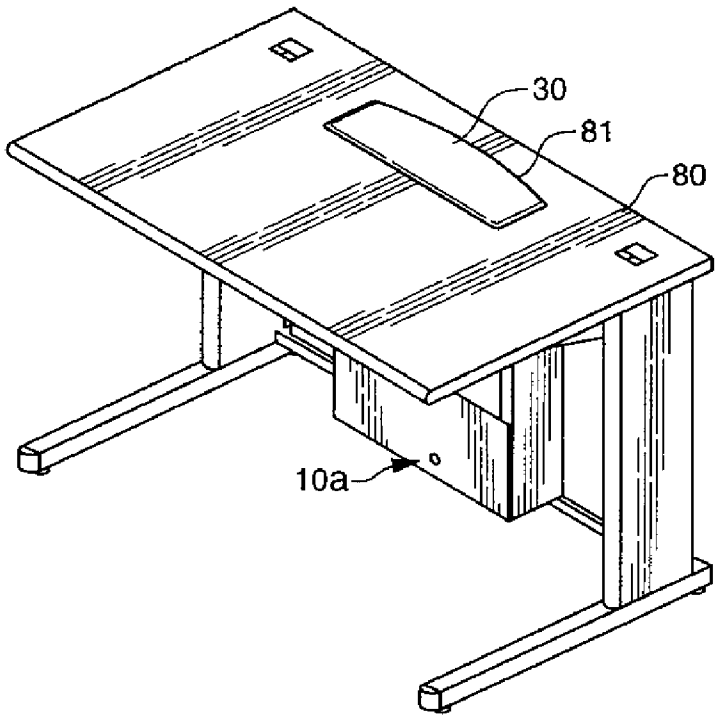
FIG. 11 is a top perspective view of a desk with a second embodiment of the invention installed therein, with the monitor in the stowed or retracted position.
Figure 12:
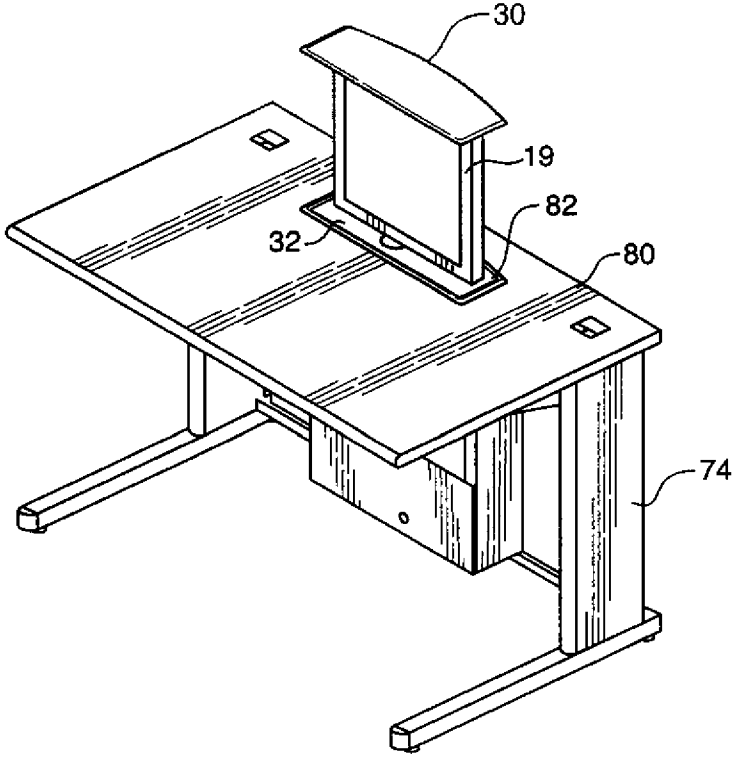
FIG. 12 is a view similar to that of FIG. 1 1 but with the monitor in the extended, use position above the top of the desk.

A second embodiment 10*a* of the computer monitor lifting mechanisms/assembly of this invention is shown in FIGS. 11 through 25. Computer monitor lifting assembly 10*a* is mounted to a desk or table 74. Aperture 82 in desktop 80 provides the opening that allows for movement of the monitor from the retracted position shown in FIG. 11 to the extended position shown in FIG. 12. Trim piece 81 may engage the periphery of aperture 82 to give the desk a more finished look and to account for any space between top plate 30 and the periphery of aperture 82. In the extended position, bottom plate 32 rests in or perhaps just a little bit above or below aperture 82 depending on the repeatability of the motion of the linear actuator described below which moves monitor support 12*a*.

Lockable monitor enclosure 14 has removable cover 15. Lock 20 can be used to control the removal of cover 15 to help prevent monitor 19 from being stolen.

Figure 13:
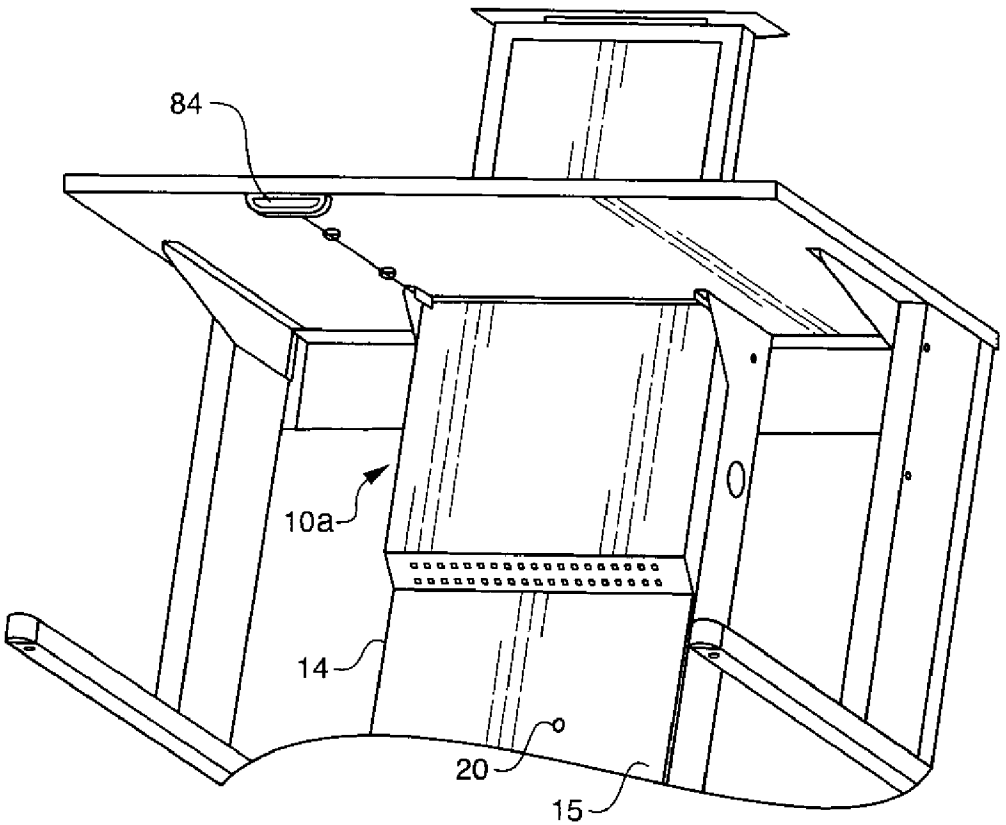
FIG. 13 is a bottom perspective view of FIG. 12.
Figure 14:
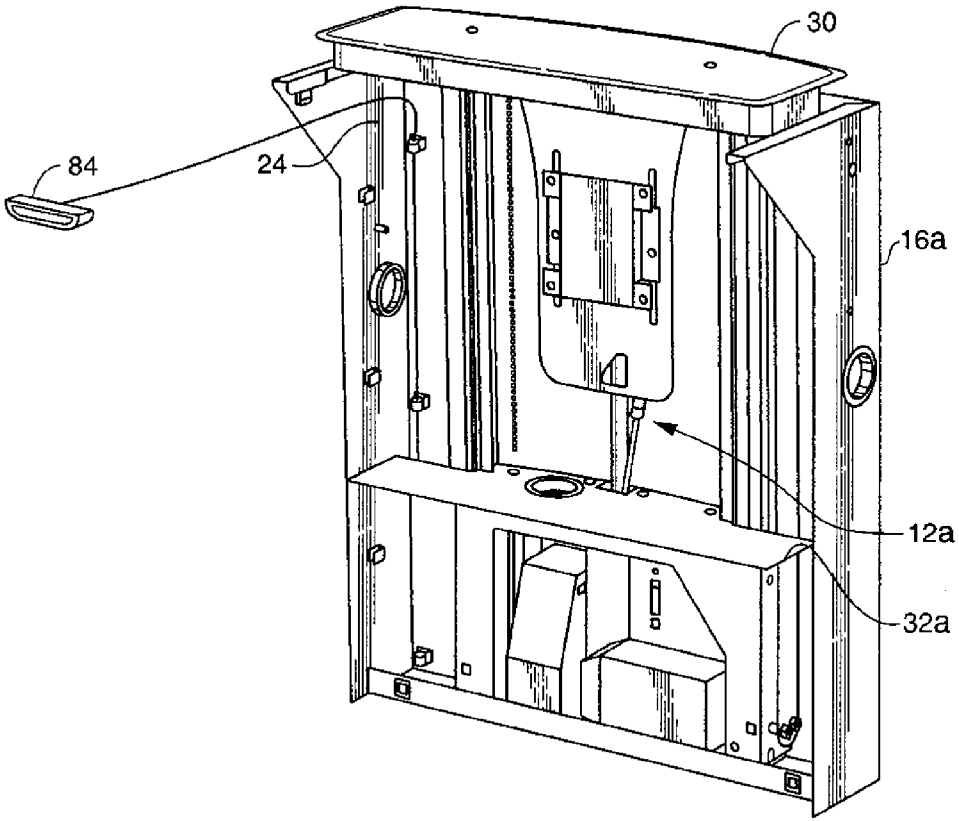
FIG. 14 is a perspective view of the second embodiment of the inventive monitor lift assembly of the invention, which is electrically operated rather than manually operated, with the cover removed and in the retracted position.
Figure 15:
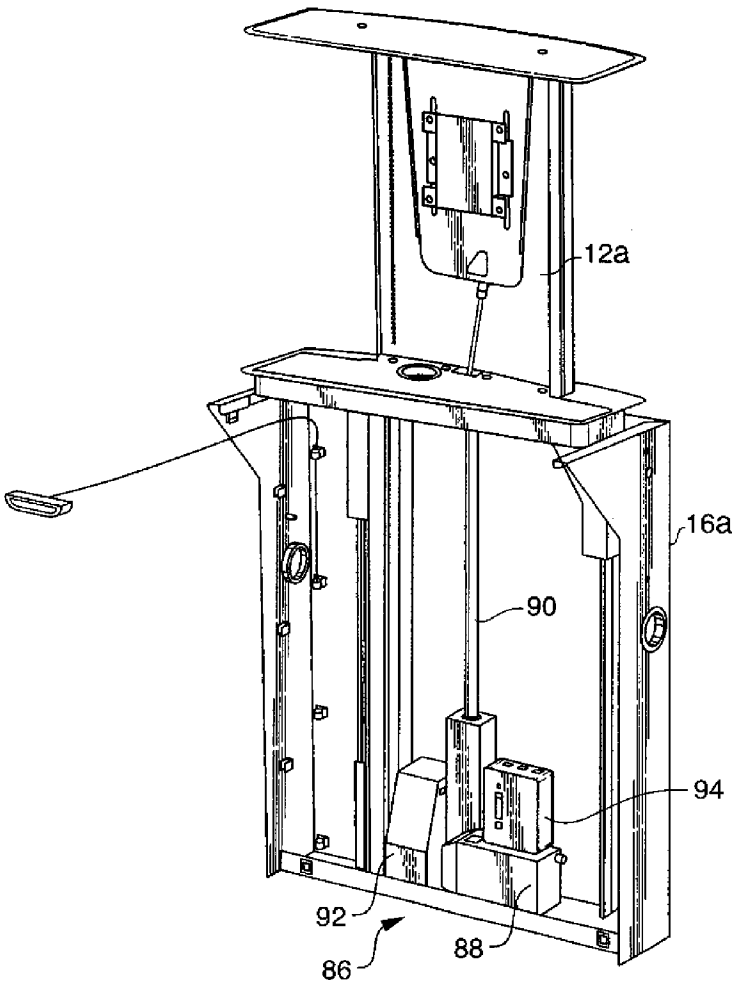
FIG. 15 is a similar view to that of FIG. 14, but with the monitor in the extended position.
Figure 16:
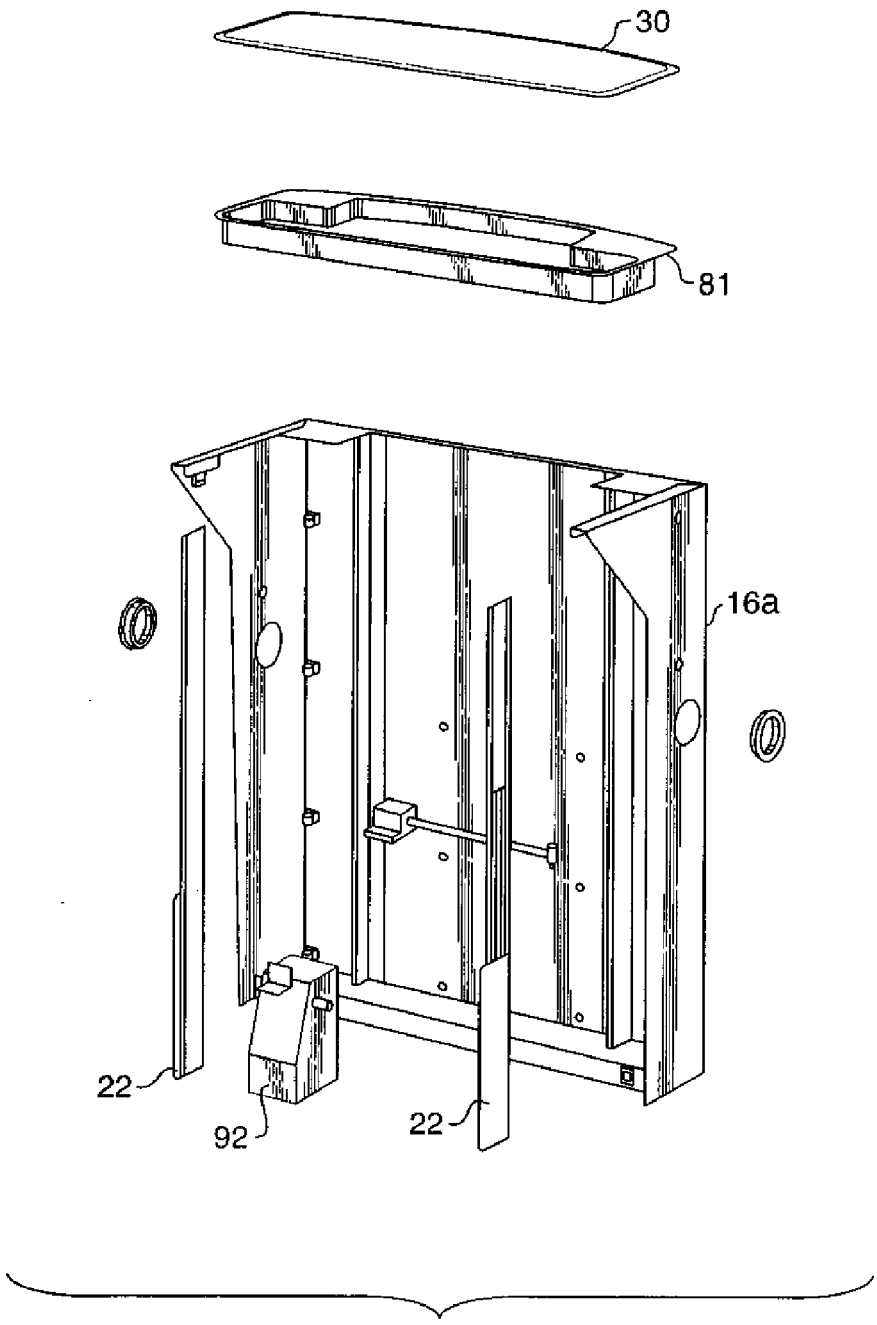
FIG. 16 is an exploded view of the stationary support member of the second embodiment.
Figure 17:
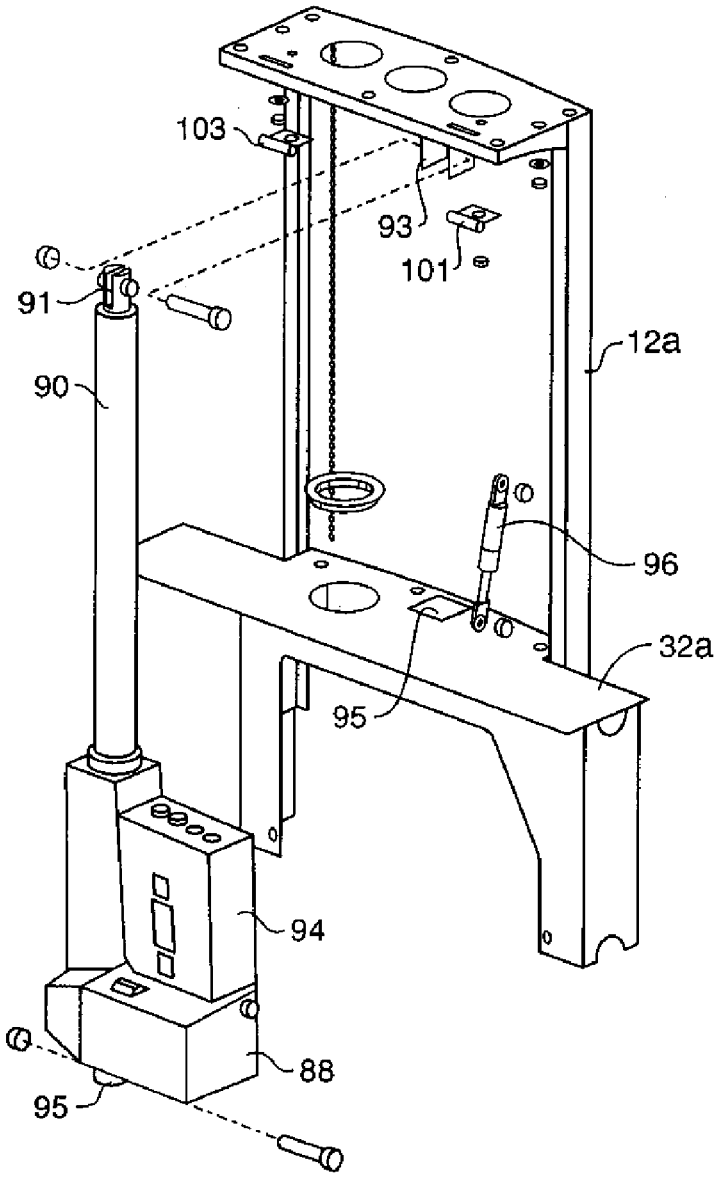
FIG. 17 is an exploded view of portions of the computer monitor support and the electrically-operated lifting device for this second embodiment.

This embodiment is very similar to the first embodiment with the exception that the motion of the computer monitor support is accomplished by an electrically-operated lifting device. In the embodiment shown, this electrically-operated lifting device is accomplished with linear actuator assembly 86 comprising actuator shaft 90, shaft drive motor and transmission 88, actuator control box 94, and transformer 92 that steps the line voltage down to the appropriate voltage for the linear actuator. User-operable switch 84 controls the linear actuator to raise or lower the monitor by the push of switch 84, which may be mounted to the front underside of the desktop as shown in FIG. 13. Assembly 86 is preferably an electric linear actuator, but may be accomplished by other means such as hydraulically. In the described embodiment, shaft 90 comprises a ball screw or lead screw driven by motor 88 through a mechanical transmission, e.g. a double worm gear and spindle nut. Assembly 86 may comprise an actuator, control box, transformer and switch available from LINAK U.S., Inc. of Louisville, Ky. The total nominal travel may be about 17", with a lifting capacity of about 225 pounds. Motor 88 does not apply force in the downward direction. This can be accomplished with a mechanical spline feature in the motor. This is for safety reasons, to prevent finger pinching or monitor damage, for example. The entire lift retracts only with the weight of the tower and monitor.

Figure 18:
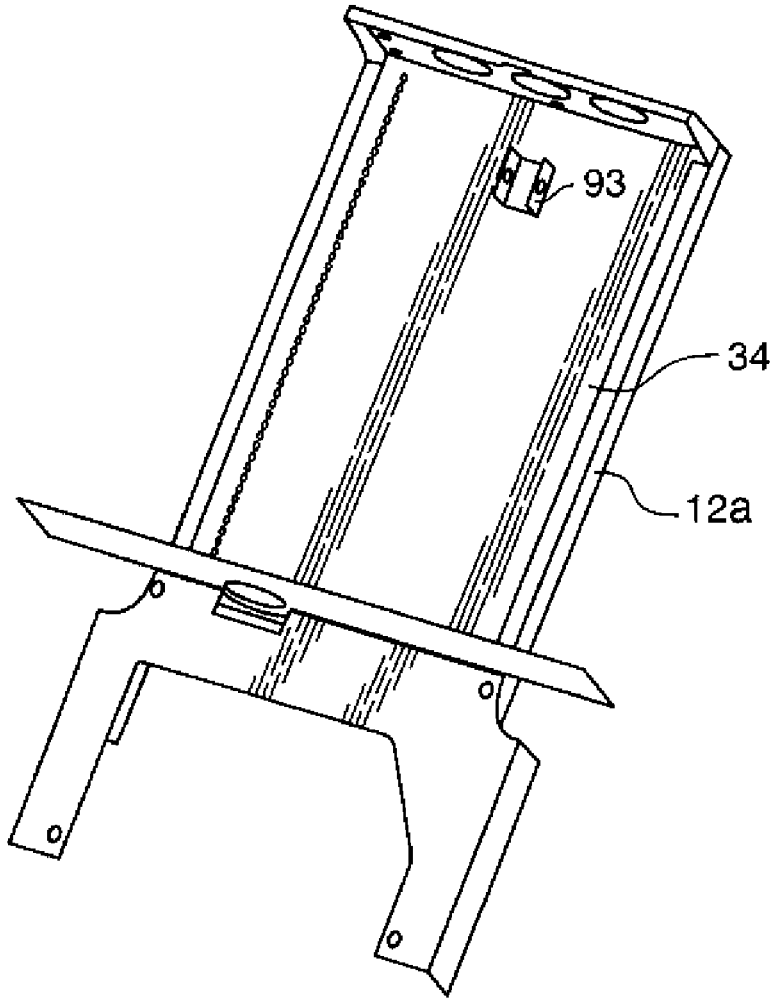
FIG. 18 is a more detailed view of the tower portion of the computer monitor support of FIG. 17.
Figure 19:
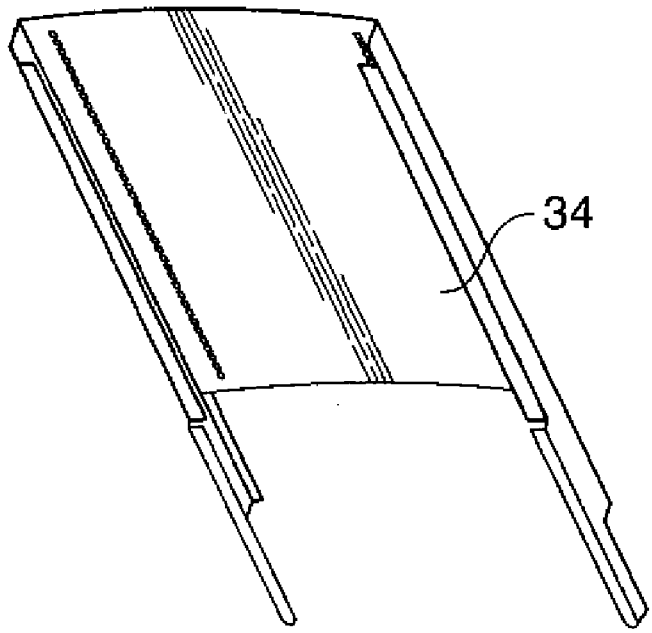
FIG. 19 is a more detailed view of the cover for the tower of FIG. 18.
Figure 20:
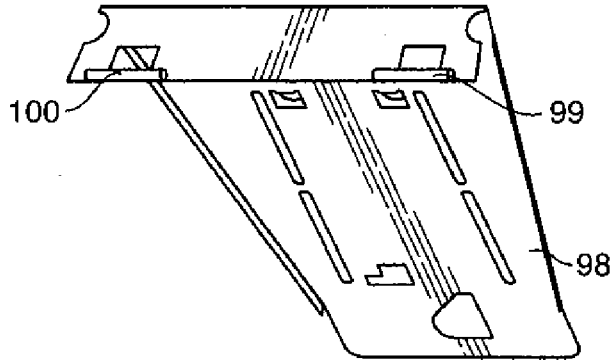
FIG. 20 is a more detailed view of the tilt member for the second embodiment of the computer monitor support.
Figure 21:
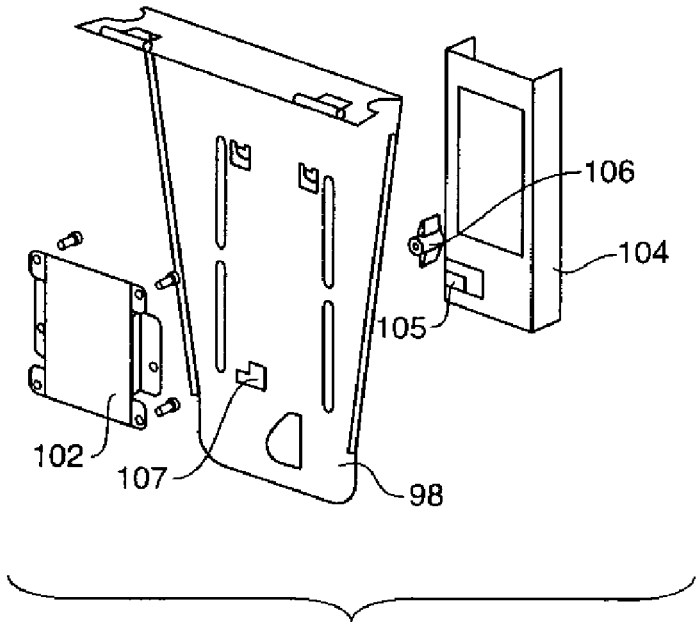
FIG. 21 is an exploded view of the tilt member, computer monitor mounting plate and locking device for the second embodiment of the computer monitor support.
Figure 22:
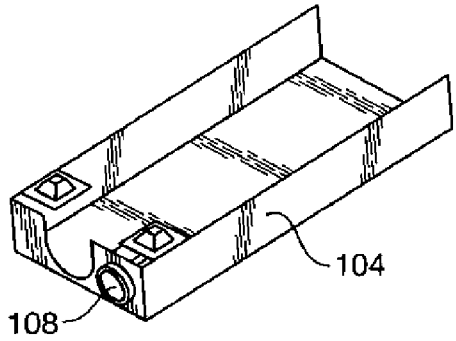
FIG. 22 is a more detailed view of the locking device of FIG. 21.
Figure 23:
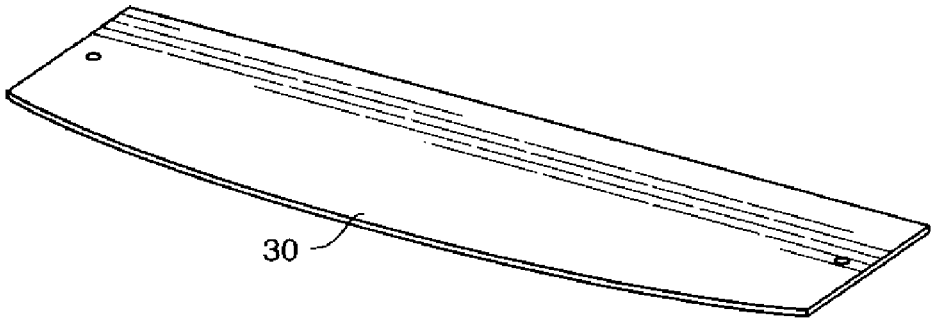
FIG. 23 is a detailed view of the upper decorative portion of the top horizontal member of the preferred embodiments.
Figure 24:
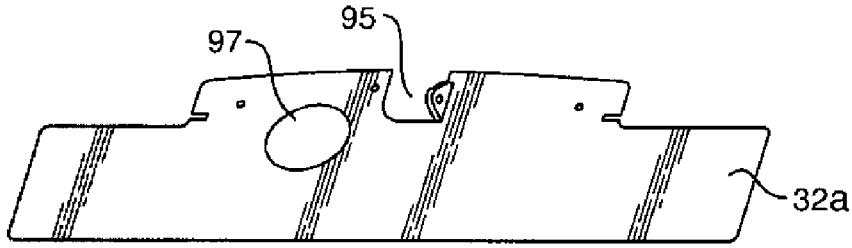
FIG. 24 is a detailed view of the lower horizontal member of the second preferred embodiment of the invention.
Figure 25:
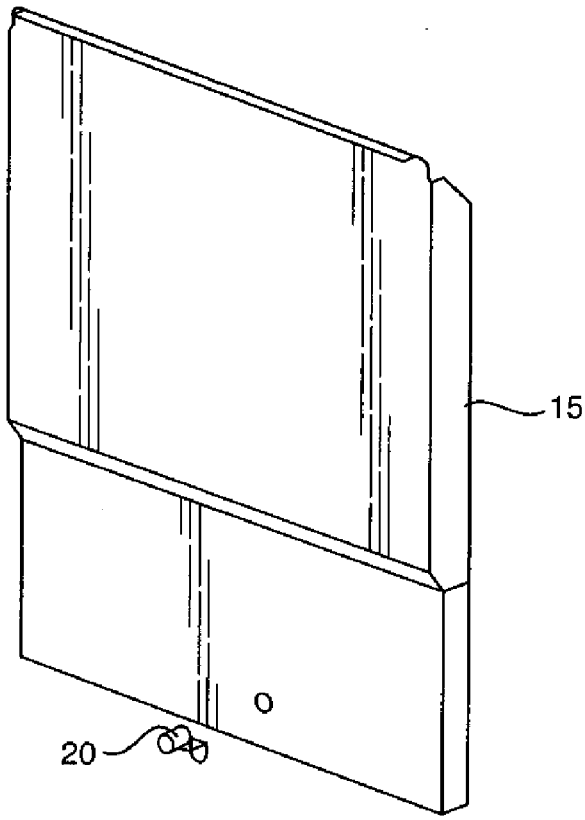
FIG. 25 is a perspective view of the lockable cover for the stationary support, for both embodiments of the invention.

Shaft 90 is coupled to monitor support 12*a* through shaft coupling element 91 fastened to mounting clip 93 on monitor support 12*a*. Shaft 90 passes through opening 95 in bottom plate 32*a*. In this manner, as shaft 90 extends out from and is retracted back towards motor 88, monitor support 12*a* is moved up and down, respectively, relative to stationary support mechanism 16*a*. Monitor support 12*a* preferably moves on a pair of linear ball bearing slides 22, one on each side of computer monitor support 12*a*. FIG. 18 shows mounting clip 93 mounted to back plate 34 of monitor support 12*a*. Opening 97 in lower plate 32*a*, which is preferably finished with a plastic bushing, is provided for the wiring that needs to run to the monitor.

In the preferred embodiment, the monitor is both locked to the monitor support and also enabled to move (tilt) relative to the support. This can be accomplished as follows. Tilt member 98 is coupled through hinge mounting structures 99 and 100 that engage with hinges 101 and 103 that are attached to back plate 34 of monitor support 12*a*. This allows member 98 to tilt in and out with respect to back plate 34. Gas spring 96 is pivotably coupled to bottom plate 32*a* and to member 98 to support member 98 in the tilted position desired by the user.

Locking of the monitor to the monitor support can be accomplished as follows. The monitor is coupled to standard VESA mount 92. Mount 92 is coupled to member 98 with two or more bolt and wing nut 106 combinations. The bolts pass through the vertical slots in member 98. Locking can be accomplished by including locking member 104 that, when in place on the back of member 98, prevents wing nuts 106 from being turned. This can be accomplished by including a lock pawl 105 that is selectively engagable and disengagable with member 98 through opening 107. Pawl 105 is moved by key lock 108. In this fashion, member 104 can be locked to the back of member 98, which prevents wing nuts 106 from being turned. Only the person with the key for lock 108 can remove the monitor mounted to mount 102.

Although specific embodiments have been illustrated and described, as noted above, the invention could be resized to accommodate monitors in larger or smaller ranges, including both flat screen and other monitor types. Additionally, while the lift assembly has been described for lifting a computer monitor, the device could also be applied for an entire computer set-up and/or printers or other peripheral devices, televisions, stereo systems, cameras, or other systems which are selectively displayed. Furthermore, although the device has been described for lifting the equipment vertically from beneath a desk onto a desktop, a similar device could be provided for lowering it from an overhead storage location, or in other configurations.

It should be understood that the embodiments described herein are exemplary and do not limit the scope of the invention, and that various modifications could be make by those skilled in the art that would fall under the scope of the invention. The scope of the invention is set forth in the following claims.

What is claimed is:

1. A computer monitor lifting assembly for moving a computer monitor that is coupled to the device between a retracted and an extended position relative to a work surface, the computer monitor lifting assembly comprising:

a stationary support member coupled beneath a work surface;

a computer monitor support moveably coupled to the stationary support member, the computer monitor support including a fixed top horizontal member and a fixed lower horizontal member spaced below the top horizontal member, the top horizontal member being sized and dimensioned to at least mostly fill an aperture in the work surface when the monitor support is in the retracted position, the top and bottom horizontal members being spaced vertically at a distance sufficient to allow a computer monitor to be coupled to the monitor support between them;

a lifting device coupled to the monitor support, the lifting device providing an upward lifting force directed against the weight of the monitor and the monitor support to move the monitor support from the retracted, up through the aperture in the work surface, to the extended position; and a user-operable control for selectively operating the lifting device.

2. The computer monitor lifting assembly of claim 1 wherein the lifting device is electrically operated.

3. The computer monitor lifting assembly of claim 2 wherein the lifting device also provides a downward force that returns the monitor support from the extended to the retracted position.

4. The computer monitor lifting assembly of claim 2 wherein the lifting device comprises a linear actuator.

5. The computer monitor lifting assembly of claim 4 wherein the linear actuator comprises an actuator shaft coupled to the monitor support.

6. The computer monitor lifting assembly of claim 5 wherein the linear actuator further comprises an electric motor adapted to move the shaft outward and inward with respect to the motor.

7. The computer monitor lifting assembly of claim 6 wherein the linear actuator further comprises a mechanical coupling that translates motor motion to motion of the shaft.

8. The computer monitor lifting assembly of claim 1 wherein the monitor support comprises a first mechanical member.

9. The computer monitor lifting assembly of claim 8 wherein the monitor support further comprises a tilt member that is movably coupled to the first member.

10. The computer monitor lifting assembly of claim 9 wherein the monitor support further comprises a computer monitor mounting plate to which the monitor is attached.

11. The computer monitor lifting assembly of claim 10 wherein the mounting plate is coupled to the tilt member.

12. The computer monitor lifting assembly of claim 9 wherein the tilt member is coupled to the first member with at least one hinge.

13. The computer monitor lifting assembly of claim 9 wherein the monitor support further comprises a mechanical device for holding the tilt member in a desired position relative to the first member.

14. The computer monitor lifting assembly of claim 13 wherein the mechanical device for holding the tilt member in a desired position relative to the first member comprises a gas spring.

15. The computer monitor lifting assembly of claim 10 wherein the monitor support further comprises a mechanical locking device that inhibits removal of the mounting plate from the tilt member.

16. The computer monitor lifting assembly of claim 15 wherein the mounting plate is coupled to the tilt member with one or more fastener and nut combinations.

17. The computer monitor lifting assembly of claim 16 wherein the locking device prohibits the nuts from being removed from the fasteners.

18. The computer monitor lifting assembly of claim 17 wherein the locking device comprises a second mechanical member that is selectively coupled to the tilt member by a lock member.

19. The computer monitor lifting assembly of claim 1 wherein the lifting device is adapted to move the monitor support a distance essentially equal to the distance between the top horizontal member and the lower horizontal member.

20. The computer monitor lifting assembly of claim 1 wherein the user-operable control comprises a switch.

21. The computer monitor lifting assembly of claim 1 wherein the work surface is the top of a desk.

22. The computer monitor lifting assembly of claim 21 wherein the user-operable control is accessible by a user sitting at the desk.

23. The computer monitor lifting assembly of claim 21 further comprising a trim piece lining the inside of the aperture.

24. The computer monitor lifting assembly of claim 1 wherein the computer monitor support is moveably coupled to the stationary support through a linear slide mechanism.

25. The computer monitor lifting assembly of claim 24 wherein the linear slide mechanism comprises a pair of linear ball bearing slides, one on each side of the computer monitor support.

26. The computer monitor lifting assembly of claim 1 further comprising an enclosure for enclosing the computer monitor when the computer monitor is in the retracted position.

27. The computer monitor lifting assembly of claim 26 wherein the enclosure is lockable.

28. A computer monitor lifting assembly for moving a computer monitor that is coupled to the device between a retracted and an extended position relative to a work surface, the computer monitor lifting assembly comprising:

a stationary support member coupled beneath a work surface;

a computer monitor support moveably coupled to the stationary support member, the computer monitor support including a fixed top horizontal member and a fixed lower horizontal member spaced below the top horizontal member, the top horizontal member being sized and dimensioned to at least mostly fill an aperture in the work surface when the monitor support is in the retracted position, the top and bottom horizontal members being spaced vertically at a distance sufficient to allow a computer monitor to be coupled to the monitor support between them;

an electrically-operated lifting device coupled to the monitor support, the lifting device providing an upward lifting force directed against the weight of the monitor and the monitor support to move the monitor support from the retracted, up through the aperture in the work surface, to the extended position and also providing a downward force that returns the monitor support from the extended to the retracted position; and a user-operable switch for selectively operating the lifting device.

29. A computer monitor lifting assembly for moving a computer monitor that is coupled to the device between a retracted and an extended position relative to the top surface of a desk or table, the computer monitor lifting assembly comprising:

a stationary support member coupled beneath the top surface of the desk or table;

a computer monitor support moveably coupled to the stationary support member, the computer monitor support including a fixed top horizontal member and a fixed lower horizontal member spaced below the top horizontal member, the top horizontal member being sized and dimensioned to at least mostly fill an aperture in the top surface when the monitor support is in the retracted position, the top and bottom horizontal members being spaced vertically at a distance sufficient to allow a computer monitor to be coupled to the monitor support between them;

an electrically-operated motor-driven linear actuator coupled to the monitor support, the linear actuator providing an upward lifting force directed against the weight of the monitor and the monitor support to move the monitor support from the retracted, up through the aperture in the top surface, to the extended position and also providing a downward force that returns the monitor support from the extended to the retracted position; and a user-operable switch for selectively operating the linear actuator.

30. A computer monitor lifting assembly for moving a computer monitor that is coupled to the device between a retracted and an extended position relative to a work surface, the computer monitor lifting assembly comprising;

a stationary support member coupled beneath a work surface;

a computer monitor support moveably coupled to the stationary support member, the computer monitor support including a fixed top horizontal member, the top horizontal member being sized and dimensioned to at least mostly fill an aperture in the work surface when the monitor support is in the retracted position;

a lifting device coupled to the monitor support, the lifting device providing an upward lifting force directed against the weight of the monitor and the monitor support to move the monitor support from the retracted, up through the aperture in the work surface, to the extended position; and a user-operable control for selectively operating the lifting device.

31. The computer monitor lifting assembly of claim 30 wherein the lifting device is electrically operated.

* * * * *